US005120268A

United States Patent [19]

Gerrans

[11] Patent Number: 5,120,268

[45] Date of Patent: Jun. 9, 1992

[54] MARINE ELECTRICAL CONNECTOR

[76] Inventor: Al Gerrans, P.O. Box 461, Cypress, Tex. 77429

[21] Appl. No.: 563,506

[22] Filed: Aug. 7, 1990

[51] Int. Cl.[5] ..... H01R 13/56

[52] U.S. Cl. ..... 439/736; 439/278; 439/283; 439/933

[58] Field of Search ..... 439/200, 201, 278, 281, 439/283, 624, 91, 736, 933, 934; 156/293, 304.5, 166, 175, 172

[56] References Cited

U.S. PATENT DOCUMENTS

| | | | |
|---|---|---|---|
| 2,843,153 | 7/1958 | Young | 156/175 X |
| 3,449,182 | 6/1969 | Wiltshire | 156/172 X |
| 3,497,864 | 2/1970 | Barnet | 439/278 X |
| 3,693,133 | 9/1972 | Harbonn et al. | 439/278 |
| 4,461,529 | 7/1984 | Fariss | 439/736 X |
| 4,589,939 | 5/1986 | Mohebban | 439/933 X |
| 4,820,170 | 4/1989 | Redmond et al. | 439/91 X |
| 4,861,288 | 8/1989 | Friedman | 439/933 X |

*Primary Examiner*—Larry I. Schwartz
*Assistant Examiner*—J. R. Daulton
*Attorney, Agent, or Firm*—Bernard A. Reiter

[57] ABSTRACT

A connector for use in marine environments made of an exterior plastic housing characterized by fiberglass impregnation constituting 15% to 65% by weight thereof and a plastic core enclosing therewithin and electrical conductors. The housing is made of a plastic compatible with and fused into the plastic core.

8 Claims, 1 Drawing Sheet

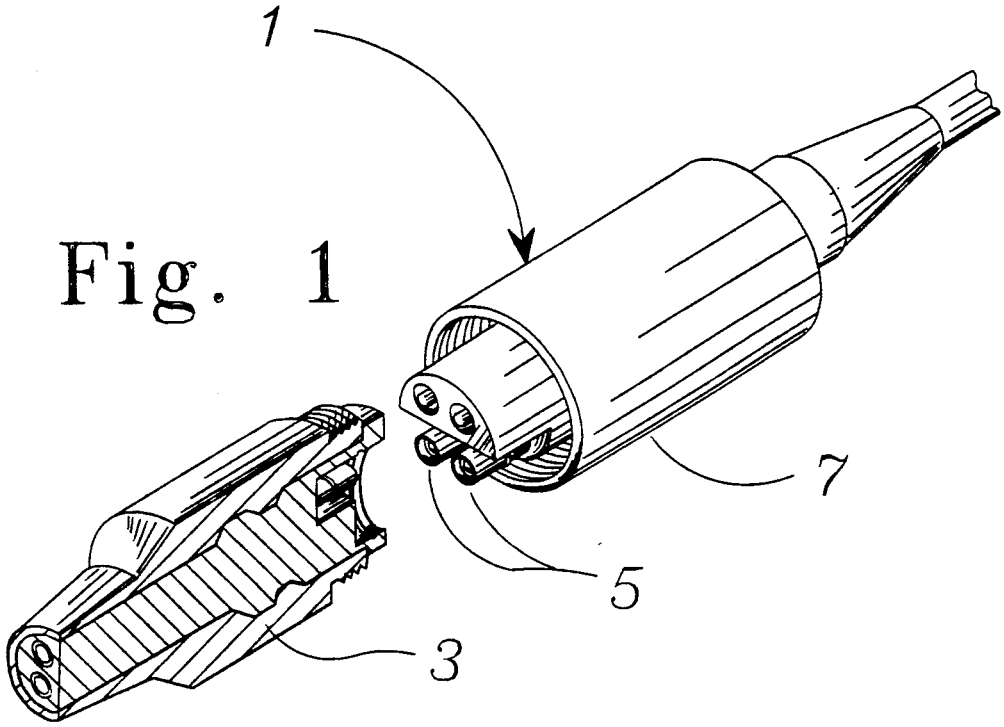
Fig. 1
Fig. 2
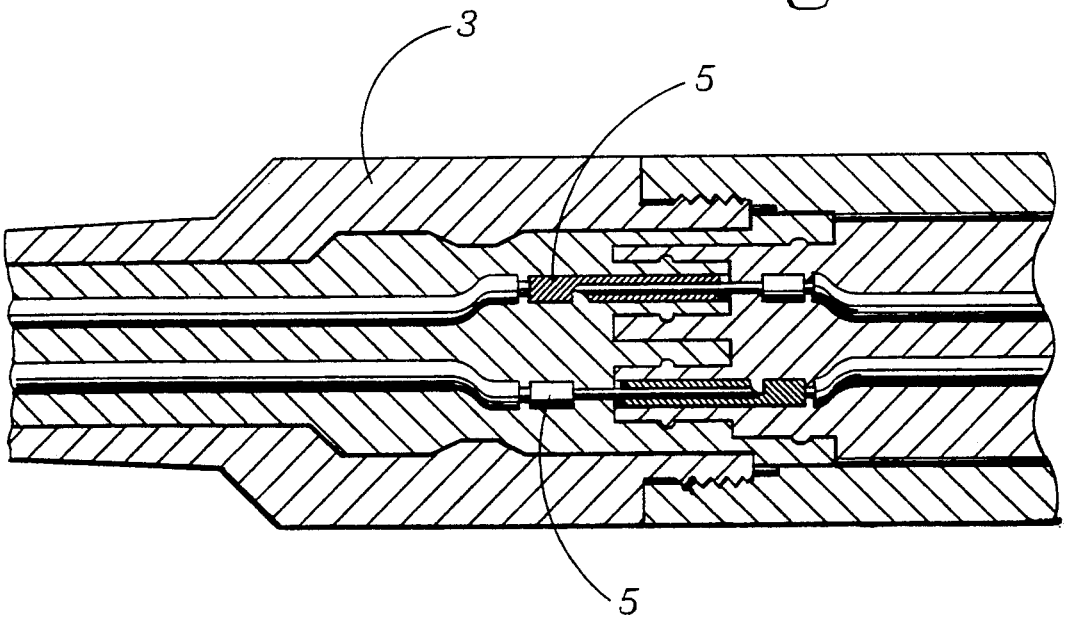

MARINE ELECTRICAL CONNECTOR

BACKGROUND OF THE INVENTION

Underwater electrical cables and marine conductors in general cause major problems when they begin to leak. Leakage of course is common due to the fact that such cables, and their connectors, commonly operate in subsurface environments or in near surface atmospheric environments characterized by extreme salt and humidity. The primary water and humidity sealing means in underwater connectors is generally the insulation encapsulating the strands of individual conductors, or it is an encapsulating plastic around the machined stainless steel connector. Frequently, these connectors are made of corrosion resistant metals, such as stainless, or the like, and are coated with a plastic coating for the purpose of precluding entry of moisture.

Further, in marina seismic operations, underwater electrical plugs or connectors are needed to connect power and instrumentation conductors to other equipment, such as seismic sound generators, i.e., air guns. These "guns" are used as a sound source to obtain acoustic reflections from the sea-floor. Typically, they are fired every ten to fifteen seconds producing extremely strong pressure waves. As a result, the electrical cables, conductors and connectors are subjected to a great deal of structural abuse, and normally they may not last for extended periods of time before developing leaks or other operational defects. Typically, these components, such as electrical connectors, are exposed to such blasting forces and also to the extremely adverse nature of the environment, and will not last long if they are not able to withstand the conditions. Therefore, all of the electrical connectors and other components used in these harshest of environments must necessarily withstand repeated explosive forces on their exteriors while allowing for a degree of flexibility therewithin lest the internal conductor be jolted loose from its external housing. This is best accomplished by having a rigid or very strong external housing material which will not fracture while simultaneously precluding leakage from without. Also, however the electrical conductor inside the housing must be mounted within a flexible shock absorbent material in order that repeated percussive forces do not produce a short in the circuit. Applicant is unaware of the fact that conductors may have relatively hard external housings. The conductors do not have flexible shock absorbent interiors. Moreover, the exterior and interior are commonly of different materials, such as for example metal and rubber, thus necessitating a difficult and expensive bonding technique which frequently results in an unreliable adhesion. This is believed to be true whenever different materials of substantially different hardness and/or density are bonded together. Applicant is unaware of a marina electrical connector having a relatively hard external housing and a relatively soft internal, flexible core capable of absorbing sudden shock and adverse external conditions and in which the two materials are substantially the same so as to facilitate reliable long term bonding there between.

Accordingly, it is a primary purpose of the invention disclosed hereinafter to provide an electrical connector which solve the problems described above and which can be utilized in marine seismic operations. Another purpose of the present invention is to improve the shock absorbing capabilities of electrical connectors through the use of a flexible internal core that enhances absorption of shock and hence minimizes electrical circuit disturbance, and which further is characterized by a relatively hard external housing to protect the flexible internal core against physical damage from sudden impacts of usage.

Another significant feature and advantage of the present invention is to provide a marine connector which markedly reduces the substantial costs associated with current steel, or other metal, electrical connectors. These electrical connectors, commonly used today, are characterized by a plurality of component parts, each of which must be machined in a series of close tolerance machining operations. These operations are extremely costly and are essentially eliminated by the invention herein.

Accordingly, it is another principal object of this invention to provide an electrical connector which, despite its necessary usage in the marine industry is not made of stainless steel or any other metal alloy normally resistant to corrosion and other abusive environmental conditions. Instead, applicant has discovered a method for making reliable multi-component electrical connectors which, heretofore, were not capable of reliable permanent fusion to one another. The dual material electrical connector of the invention is characterized by a flexible shock absorbent internal core and relatively hard external housing, each fusingly connected to one another in an irrevocable bond. Heretofore, the state of the art has not, to applicant's knowledge shown an ability to produce a flexible internal core surrounding the conductors which could be reliably bonded to the external housing.

Applicant has discovered the use of a glass impregnated external housing consisting of a hard plastic material and an interior shock absorbent flexible material of substantially the same plastic which obviates the short comings of the prior art and which not only enables the production of electrical connectors capable of operational advantages over that which has been known heretofore but which are markedly simpler to make and less expensive. These operational advantages and consequent cost saving techniques described herein are accomplished in a connector which can be manufactured from plastics, instead of metal which must be machined in a series of expensive and time consuming operations. The external plastic and internal plastic, though of different hardnesses, are irrevocable bonded or fused to one another because of their same molecular structure. As a consequence, the electrical connector of the invention can be marketed at a significant savings in price over that which is present in the current marketplace. The above advantages, and numerous other features and advantages of the invention, will become more readily apparent upon a careful reading of the following detailed description, claims and drawings, wherein like numerals denote like parts in the several views, and wherein:

BRIEF DESCRIPTION OF THE DRAWINGS

FIG. 1 illustrates a cross-sectional, exploded, isometric view of an electrical connector in accordance with the principals of this invention.

FIG. 2 is a cross-sectional view along the longitudinal axis of FIG. 1.

SUMMARY OF THE INVENTION

The present invention provides an electrical connector having a flexible, that is resilient, internal core encapsulating the electrical conductors which preferably is made of a polyurethane material, and an external housing surrounding the core made of a glass impregnated polyurethane. Since the material of the external housing is the same as the internal core, it is capable of connectable fusion, upon application of heat, each to the other and therefore the integral body of the two pieces is highly suited for its use in underwater seismic exploration.

DESCRIPTION OF THE PREFERRED EMBODIMENT

In accordance with the present invention, an electrical connector 1 for underwater and/or marine environment usage in general is provided which uses a flexible internal core 3. The flexible internal core is preferably made from a polyurethane extrusion and/or injection molding compound such as BF Goodrich ESTANE® 58863 or ESTANE® 58881. ESTANE® 58863 displays excellent abrasion and out resistance with slightly lower modulus than ESTANE® 58810 compound. It is found to be excellent for cable jackets, hoses, tubings, gaskets, and diaphragms. There follows a description of the mechanical parameters published by the manufacturer with respect to these materials.

ESTANE® 58863
Polyether-based Extrusion and Injection Molding Compound

| | ASTM | Sample | Typical Values SI Units | Typical Values in-lb Units |
|---|---|---|---|---|
| Shore Hardness | D 2240 | 2 | 85 A | 85 A |
| Tensile Strength | D 412 | 1 | 40.7 MPa | 5900 psi |
| Tensile Stress @ 100% Elongation | D 412 | 1 | 6.9 MPa | 1000 psi |
| Tensile Stress @ 300% Elongation | D 412 | 1 | 11.0 MPa | 1600 psi |
| Ultimate Elongation | D 412 | 1 | 600% | 600% |
| Tensile Set @ 200% Elongation | D 412 | 1 | 25% | 25% |
| Vicat Softening Point | D 1525 | 2 | 98° C. | 208° F. |
| Compression Set | D 395 | | | |
| 22 Hrs. @ 23° C. | | 2 | 20% | 20% |
| 22 Hrs. @ 70° C. | | 2 | 66% | 66% |
| Glass Transition Temp. | DSC | 3 | −50° C. | |
| Tear Resistance | D 624 | 2 | 66.5 kn/m | 380 lb/in |
| Tear Resistance | D 470 | 1 | 22.8 kn/m | 130 lb/in |
| Specific Gravity | D 792 | 2 | 1.12 | 1.12 |
| Low Temperature Stiffness | D 1053 | | | |
| Modules of Rigidity @ 23° C. | | 2 | 6.0 MPa | 875 psi |
| Modules of Rigidity @ 0° C. | | | 7.2 MPa | 1050 psi |
| Modules of Rigidity @ −20° C. | | | 12.1 MPa | 1750 psi |
| Modules of Rigidity @ −40° C. | | | 117 MPa | 17000 psi |
| Modules of Rigidity @ −50° C. | | | 345 MPa | 50000 psi |
| Modules of Rigidity @ −55° C. | | | 496 MPa | 72000 psi |

ESTANE® 58881

ESTANE® 58881 compound is the softest ESTANE® polyether compound and displays exceptionally good low temperature flexibility, toughness and abrasion resistance. It is used for cable jackets, gaskets, hose and profiles.

| | ASTM | Sample | Typical Values SI Units | Typical Values in-lb Units |
|---|---|---|---|---|
| Shore Hardness | D 2240 | 2 | 80 A | 80 A |
| Tensile Strength | D 412 | 1 | 23.4 MPa | 3400 psi |
| Tensile Stress @ 100% Elongation | D 412 | 1 | 4.8 MPa | 700 psi |
| Tensile Stress @ 300% Elongation | D 412 | 1 | 6.8 MPa | 980 psi |
| Ultimate Elongation | D 412 | 1 | 710% | 710% |
| Tensile Set @ 200% Elongation | D 412 | 1 | 10% | 10% |
| Vicat Softening Point | D 1525 | 2 | 68° C. | 154° F. |
| Compression Set | D 395 | | | |
| 22 Hrs. @ 23° C. | | 2 | 18% | 18% |
| 22 Hrs. @ 70° C. | | 2 | 61% | 61% |
| Glass Transition Temp. | DSC | 3 | −51° C. | −60° F. |
| Tear Resistance | D 624 DieC | 2 | 55.1 kn/m | 315 lb/in |
| Tear Resistance | D 470 | 1 | 17.5 kn/m | 100 lb/in |
| Specific Gravity | D 792 | 2 | 1.10 | 1.10 |
| Low Temperature Stiffness | D 1053 | | | |
| Modules of Rigidity @ 23° C. | | 2 | 4.1 MPa | 600 psi |
| Modules of Rigidity @ 0° C. | | | 4.8 MPa | 700 psi |
| Modules of Rigidity @ −20° C. | | | 5.9 MPa | 860 psi |
| Modules of Rigidity @ −40° C. | | | 11.7 MPa | 1700 psi |
| Modules of Rigidity @ −50° C. | | | 145 MPa | 21000 psi |
| Modules of Rigidity @ −55° C. | | | 296 MPa | 43000 psi |

The aforementioned plastics are proposed by way of example for use in connection with the current invention. These plastics, and any other constituting a substantial equivalent and appropriate for the purposes here intended may, when used in accordance with techniques recommended by the manufacturer, BF Goodrich Chemical Group, be used for molding, through injection or other appropriate techniques a flexible interior core of the connector hereof. As shown in the drawing, the interior core 3 is disposed to hold the electrical conductors 5 therein. The housing 7 is molded in an appropriate form shown for exemplary purposes as a cylindrical body but which may be molded in such other form as to accomplish the intended use. The housing 7 is intended to surround and encapsulate the core 3 and shall, in accordance with the invention, be manufactured of polyurethane. The polyurethane for the housing is glass impregnated polyurethane and is best exemplified by Dow Chemical ISOPLAST® 201, a registered trademark of the Dow Chemical Company, a polyurethane which is filled with from 40% to 60% by weight, with fiberglass. When this glass impregnated polyurethane is molded it sets up as a rather hard if not semi-rigid body. The glass imparts strength as well as rigidity to the body. In the event it is desired to increase the hardness of the housing to better withstand abrasion and/or harsh treatment during usage, the fiber-glass content may be increased or conversely, lowered. It is believed that a fiberglass content in the range of 15% to 65% by weight would generally accomplish the objects of the invention as described hereinabove.

After the core has been molded in the appropriate shape and cured it is positioned to receive the housing. A molding temperature for the ESTANE in the range of 370° F. to 390° F. has been found acceptable. When the polyurethane core is thus molded into the glass impregnated polyurethane the hot material of the core causes a molecular fusion with the same material of the housing thus producing a weld-like connection between the two. The urethane bonding may be enhanced by applying a coating of THF to the parts prior to fusion. There results such a permanent bond as to become equal or greater than the tensile strength of either material by itself. Such an integral molecular bond has not been obtained in marine connectors heretofore.

Typical properties of ISOPLAST 201 are as follows:

| | ASTM Method | Typical Values English | Metric |
|---|---|---|---|
| Mechanical Properties | | | |
| Tensile Strength, Yield, psi, MPa | D638 | 7600 | 62 |
| Ultimate | | 7000 | 48 |
| Elongation, Yield. % | D638 | 8 | 8 |
| Rupture | | 86 | 86 |
| Tensile Modulus, psi, MPa | D638 | 220,000 | 1600 |
| Flexural Strength, psi, MPa | D790 | 10,400 | 72 |
| Flexural Modulus, psi, MPa | D790 | 285,000 | 1800 |
| Izod Impact Strength, ft-lb/in. J/m | D256 | | |
| Notched, ⅛" thick, 73° F. | | 15 | 800 |
| Notched, ¼" thick, 73° F. | | 12 | 640 |
| Rockwell hardness, R | D785 | 100 | 100 |
| M | | 50 | 50 |
| Taber abrasion resistance, mg | D1044 | — | 12 |
| Physical Properties | | | |
| Melt flow rate, g/10 min. | D1238 | 2 | 2 |
| Specific gravity | D792 | 1.2 | 1.2 |
| Water absorption, % 24 hrs @ 73° F. | D670 | 0.18 | 0.18 |
| Mold shrinkage, In/In, cm/cm | D955 | 0.004–0.006 | 0.004–0.006 |
| Thermal Properties | | | |
| Deflection Temperature, @ 264 psi °F., °C. | D848 | 217 | 103 |
| @ 66 psi | | 248 | 120 |
| Injection Molding Temperature, °F. 420–460 | | | |
| Extrusion Temperature, °F. 410–450 | | | |

The foregoing description of the invention is merely intended to be explanatory thereof. There are changes in the details and the materials of the described connector may be made within the scope of the appended claims without departing from the spirit of the invention such as for example ISOPLAST ® manufactured by Dow Chemical Company and BF Goodrich and others.

Therefore, that which is claimed and desired to be secured by United States Letters Patent is:

1. An electrical connector assembly for use in marine environments comprising:

a housing having a core and electrical conductors encapsulated therein and which housing is made of relatively hard plastic material; and said core being made of a material the same as the housing phrase and fused therewithin but which is softer than the housing so as to better absorb shock and other dynamic forces of the environment while the housing is harder so as to resist abrasion, abuse and corrosive forces.

2. An electrical connector for use in environmentally corrosive applications wherein:

a core encapsulating electrical conductors and which is made from a relatively soft resilient polyurethane material for absorbing dynamic environmental forces on the connector in order to protect the conductors therein; and a housing substantially encapsulating the core and from which the electrical connectors extend, said housing being made from a fiberglass impregnated polyurethane which is inherently harder than the resilient polyurethane core; and said housing and core being molecularly bonded to one another to form an integrally inseparable body in which the interior is relatively soft and resilient and the exterior is hard and shock resistant.

3. An electrical connector for use in environmentally corrosive applications which are characterized by corrosion, high impact shock, and vibration forces thereon comprising:

a core of flexible first polyurethane material capable of absorbing impact and vibrational forces and having disposed therein a conductor lead for coupling with another electrical lead; and a polyurethane housing substantially encapsulating said molded core of flexible first polyurethane material and in which there is embedded a fiberglass component for enhancing the hardness thereof, said polyurethane housing being molecularly mixable with the polyurethane molded core to thereby form an integral substantially inseparable electrical connector body.

4. The electrical connector of claim 3 wherein the fiberglass impregnated in the housing constitutes between 15% and 65% of the weight thereof.

5. The electrical connector of claim 3 wherein the polyurethane core is structurally integrally bonded to the polyurethane housing by compressive means and adhesive facilitor for penetrating the interstices of the polyurethane and housing core so as to produce a molecular fusion by the polyurethane core to the polyurethane housing in which the two bodies become a molecular unity.

6. The electrical connector of claim 5 wherein the polyurethane core is Goodrich ESTANE material and the polyurethane housing is DOW Chemical Isoplast.

7. The electrical connector of claim 5 wherein the bonding is accomplished while part of the plastic is at a temperature of over 300° F.

8. The electrical connector of claim 7 wherein the bonding is accomplished with the core material at a temperature of over 300° F.

* * * * *